US006308380B1

(12) United States Patent
Cheng

(10) Patent No.: US 6,308,380 B1
(45) Date of Patent: Oct. 30, 2001

(54) PEN CLIP MOUNTING ARRANGEMENT

(76) Inventor: Di Do Cheng, 2F., No. 56-2, Lane 600, Wu Hsing Street, Taipei (TW)

( * ) Notice: Subject to any disclaimer, the term of this patent is extended or adjusted under 35 U.S.C. 154(b) by 0 days.

(21) Appl. No.: 09/482,847

(22) Filed: Jan. 14, 2000

(51) Int. Cl.[7] ..... B43K 25/02
(52) U.S. Cl. ..... 24/11 HC; 24/11 F
(58) Field of Search ..... 24/11 HC, 11 CT, 24/11 PP, 11 CC, 11 F, 11 R, 10 R, 10 A; D19/56, 57

(56) References Cited

U.S. PATENT DOCUMENTS 1,125,144 * 1/1915 Mabie .
1,263,327 * 4/1918 Kristofek .
1,388,219 * 8/1921 Thompson .
1,412,938 * 4/1922 Halket .
1,421,318 * 6/1922 Steffan et al. .
1,479,957 * 1/1924 Cruver .
1,533,466 * 4/1925 Salz .
1,783,736 * 12/1930 Marshall .
1,794,154 * 2/1931 Cuthbert .
1,808,779 * 6/1931 Larsen .
1,961,460 * 6/1934 Slatis .
1,970,611 * 8/1934 Marshall .
2,276,891 * 3/1942 Stenersen .
3,127,647 * 4/1964 Helvitas .
3,156,960 * 11/1964 Klitzner .
3,590,441 * 7/1971 Goldbert .
4,285,101 * 8/1981 Hanna .
4,653,154 * 3/1987 Malm .
4,926,525 * 5/1990 Eylers .
6,019,536 * 2/2000 Lee .

* cited by examiner

*Primary Examiner*—James R. Brittain
(74) *Attorney, Agent, or Firm*—Rosenberg, Klein & Lee

(57) ABSTRACT

A pen clip mounting arrangement includes a penholder having two locating holes near an open top end thereof, a clip fastened to the penholder on the outside, the clip having an ornamental plate at one end and two hooked portions extended from the ornamental plate at two opposite sides and respectively hooked in the locating holes on the penholder, and a packing plate inserted into the penholder and retained between the hooked portions of the clip and an inside wall of the penholder to secure the hooked portions of the clip to the locating holes on the penholder.

2 Claims, 5 Drawing Sheets

PEN CLIP MOUNTING ARRANGEMENT

BACKGROUND OF THE INVENTION

The present invention relates to a clip for a pen, and more specifically to the mounting arrangement of a clip on a pen, which is provided with an ornamental plate, and does not deform easily when bent.

The clips of conventional pens are commonly made having a narrow, elongated profile with a trade name or logo marked thereon. Due to limited area, the trade name or logo is not prominent. There is known a pen clip welded with a broad plate for the bonding of an ornamental or advertising plate. The welding of the broad plate destroys the sense of beauty of the clip, and hinders the user in holding the pen in a particular position.

FIGS. 6 and 7 show a clip for pen according to Taiwan Patent Publication No. 300512. The clip A comprises a mounting base A1, two clamping plates A2, a spring A3 connected between the clamping plates A at one end, an ornament A5 fastened to one clamping plate A2 and the mounting base A1, and a fastener, for example, elastic band A4 provided at the mounting base A1 for securing the clip to the clip of a pen. This design of clip may not fit the design of the pen in color, material, or shape. Further, the elastic band A4 cannot secure the clip A to the clip of the pen firmly. When stretched, the clip A tends to be disconnected from the pen.

SUMMARY OF THE INVENTION

The present invention provides a pen clip mounting arrangement, which eliminates the aforesaid drawbacks. According to one embodiment of the present invention, the pen clip mounting arrangement comprises a penholder having two locating holes, a clip fastened to the penholder, the clip having two hooked portions extended from an ornamental plate thereof at two opposite sides and respectively hooked in the locating holes on the penholder, and a packing plate inserted into the penholder and retained between the hooked portions of the clip and the inside wall of the penholder to secure the clip in place. The ornamental plate may be provided with a particular design, or mounted with a badge.

DETAILED DESCRIPTION OF THE PREFERRED EMBODIMENT

Figure 1:
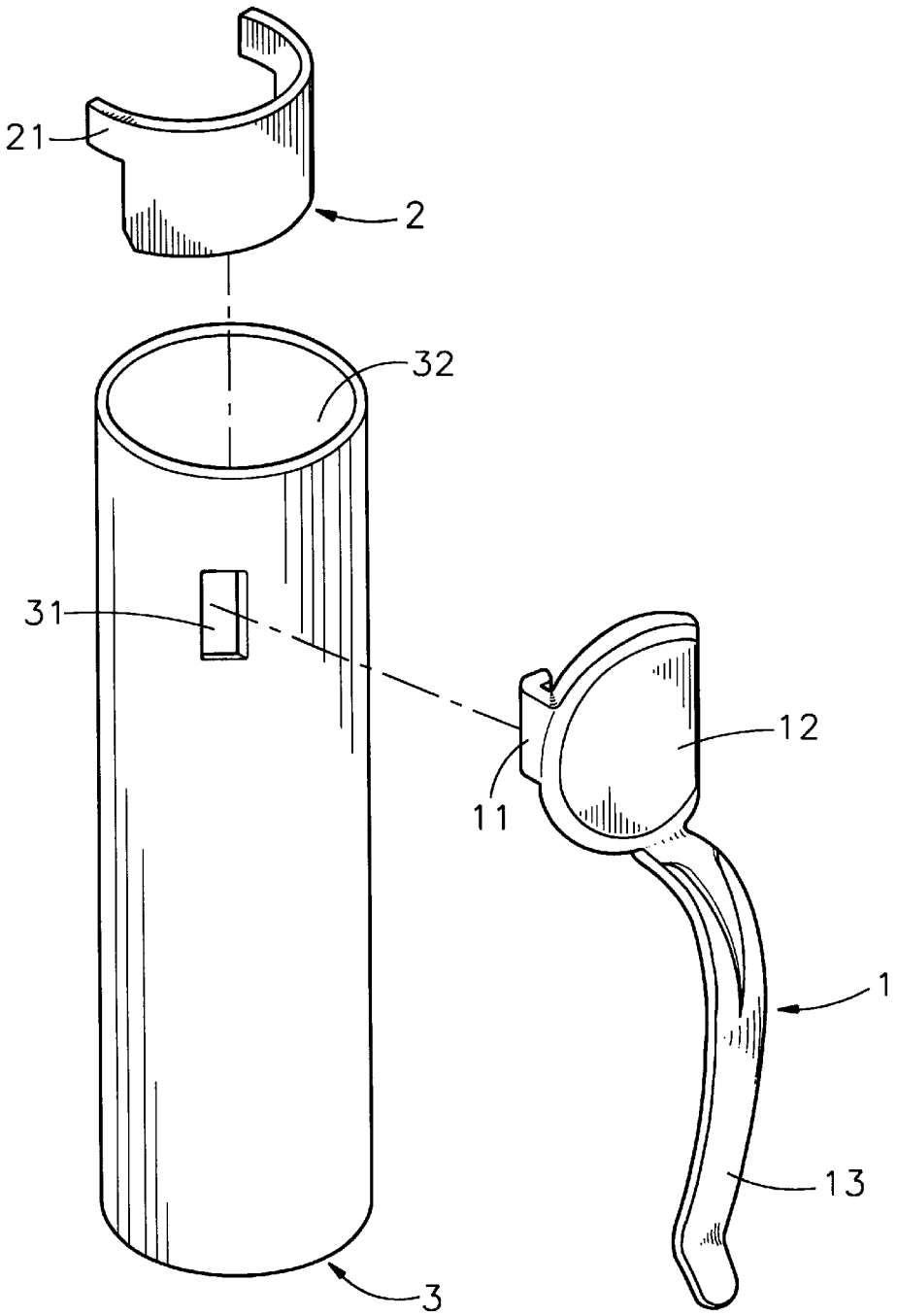
FIG. 1 is an exploded view of the preferred embodiment of the present invention.
Figure 2:
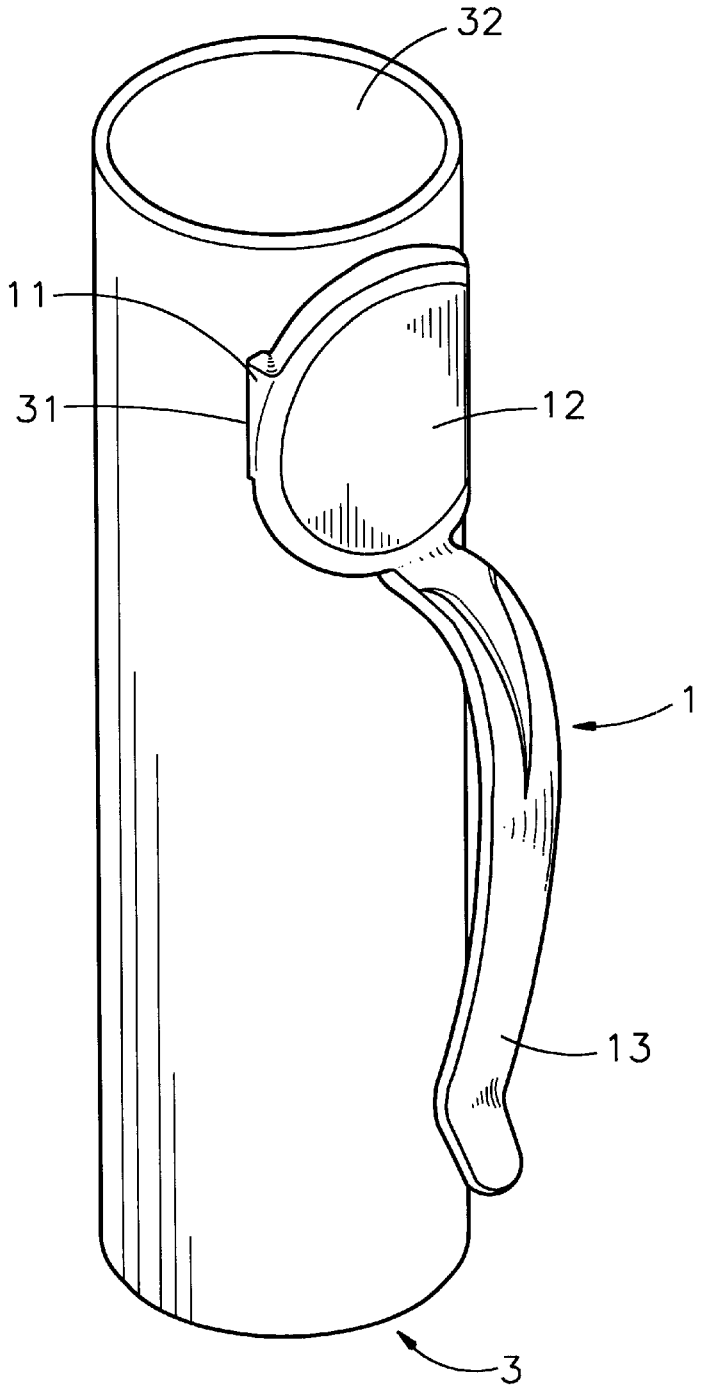
FIG. 2 is an assembly view in an enlarged scale of the pen clip mounting arrangement shown in FIG. 1.
Figure 3:
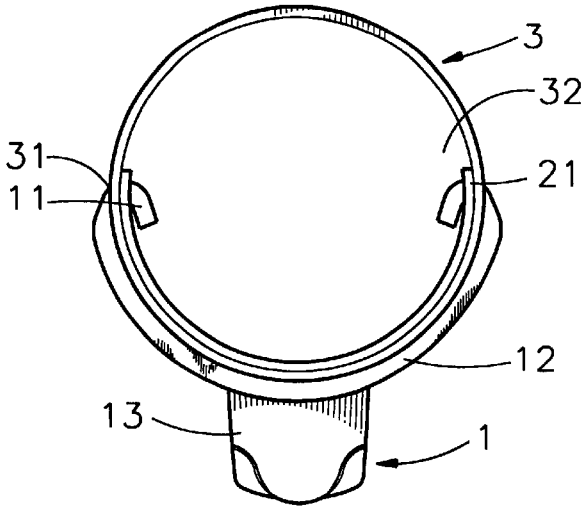
FIG. 3 is top view of FIG. 2
Figure 4:
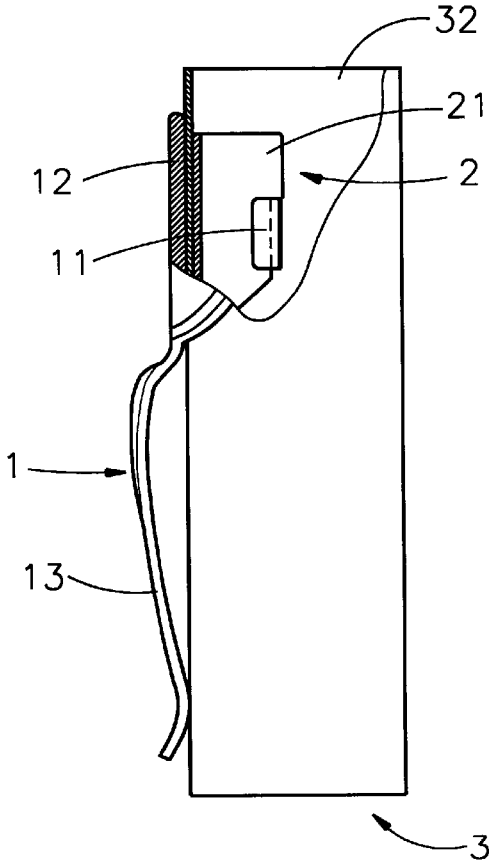
FIG. 4 is a side view in section of the pen clip mounting arrangement according to the present invention.

Referring to FIG. 1, the present invention comprises a clip 1, a packing plate 2, and a penholder 3. The clip 1 comprises an elongated, smoothly arched clip body 13, an ornamental plate 12 of a particular shape (circular, square, or any of a variety of desired shapes) at one end of the clip body 13, and two hooked portions 11 at two opposite sides of the arched ornamental plate 12. The packing plate 2 is a smoothly arched springy plate fitting the inner diameter of the penholder 3, comprising two positioning projecting portions 21 at two opposite sides. The penholder 3 comprises two locating holes 31 near the top end thereof corresponding to the hooked portions 11, and a top opening 32.

Referring to FIGS. From 2 through 4, the hooked portions 11 of the clip 1 are respectively hooked in the locating holes 31 on the penholder 3, and then the packing plate 2 is inserted into the top opening 32 in the penholder 3 and retained between the hooked portions 11 of the clip 1 and the inside wall of the penholder 3, enabling the projecting portions 21 of the packing plate 2 to be respectively stopped above the hooked portions 11 of the clip 1.

Figure 5:
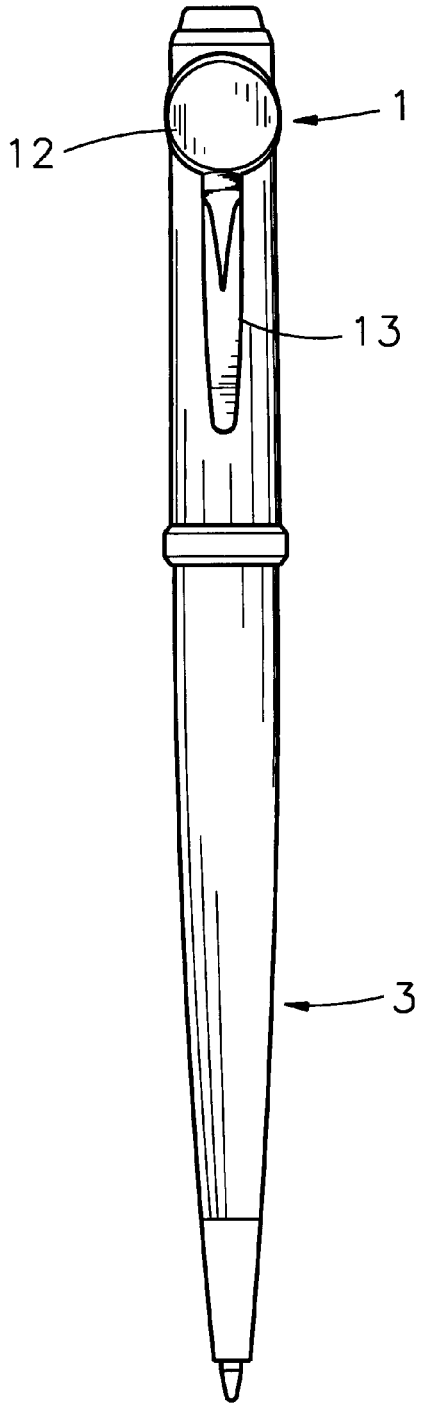
FIG. 5 shows an application example of the present invention.
Figure 6:
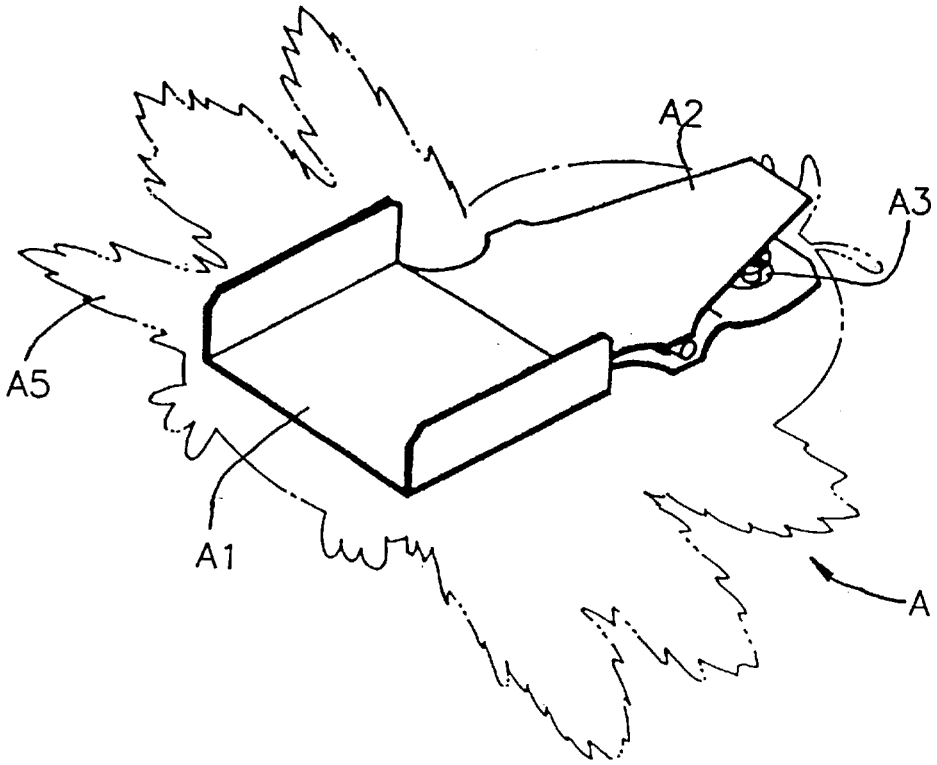
FIG.6 PRIOR ART
FIG. 6 illustrates a clip for pen according to the prior art (before the installation of the elastic band in the mounting base).
Figure 7:
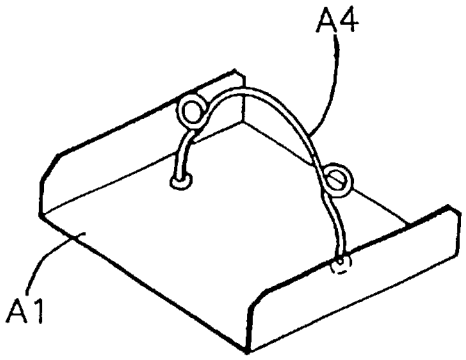
FIG.7 PRIOR ART
FIG. 7 illustrates the elastic band installed in the mounting base for the clip shown in FIG. 6.

FIG. 5 shows an application example of the present invention. According to this application example, the clip 1 is fastened to the penholder 3 near the top, and the ornamental plate 12 of the clip 1 has a circular shape. Registered trade name, property product name, logo, burst, etc. may be made on the face of the ornamental plate 12 by printing, etching, laser engraving, or any suitable measures. Alternatively, a faceplate or badge may be adhered to the ornamental plate 12.

Referring to FIGS. From 1 through 5 again, because the clip 1 is fastened to the penholder 3 by hooking the hooked portions 11 of the clip 1 in the locating holes 31 on the penholder 3, bending the clip body 13 causes the hooked portions 11 to be moved in the locating holes 31 relative to the penholder 3, preventing a deformation of the clip 1 or a damage to the connection area between the penholder 3 and the clip 1.

While only one embodiment of the present invention has been shown and described, it will be understood that various modifications and changes could be made thereunto without departing from the spirit and scope of the invention disclosed.

What the invention claimed is:

1. A pen clip mounting arrangement comprising:

a penholder having two locating holes near an open top end thereof;

a clip fastened to said penholder,said clip including an ornamental plate, and two hooked portions respectively extended from two opposite sides of said ornamental plate and respectively hooked in said locating holes in said penholder; and a packing plate inserted into said penholder and retained between said two hooked portions of said clip and an inside wall of said penholder to secure said hooked portions of said clip to said clip to said locating holes in said penholder, said packing plate including a bottom having two sides each formed with a tapered end, thereby facilitating insertion of said packing plate between said two hooked portions of said clip.

2. The pen clip mounting arrangement of claim 1 wherein said packing plate comprises two projecting portions extended from two opposite lateral sides thereof and respectively stopped above the hooked portions of said clip inside said penholder.

* * * * *